US006472462B1

(12) United States Patent
Kohlhammer et al.

(10) Patent No.: US 6,472,462 B1
(45) **Date of Patent: *Oct. 29, 2002**

(54) PREBINDING OF FIBER MATERIALS

(75) Inventors: Klaus Kohlhammer, Marktl (DE); Abdulmajid Hashemzadeh, Burgkirchen (DE); Claudia Schmidt, Altötting (DE)

(73) Assignee: Wacker-Chemie GmbH, Munich (DE)

( * ) Notice: Subject to any disclaimer, the term of this patent is extended or adjusted under 35 U.S.C. 154(b) by 27 days.

This patent is subject to a terminal disclaimer.

(21) Appl. No.: 09/707,649

(22) Filed: Nov. 6, 2000

(30) Foreign Application Priority Data

Dec. 9, 1999 (DE) ..... 199 59 415

(51) Int. Cl.[7] ..... C08K 3/34
(52) U.S. Cl. ..... 524/494; 524/495; 524/847
(58) Field of Search ..... 524/494, 495, 524/847

(56) References Cited

U.S. PATENT DOCUMENTS

| | | | |
|---|---|---|---|
| 4,054,713 | A | 10/1977 | Sakaguchi et al. |
| 5,668,216 | A | 9/1997 | Kinkel et al. |
| 5,977,244 | A | 11/1999 | Kohlhammer et al. |

FOREIGN PATENT DOCUMENTS

| | | |
|---|---|---|
| AU | 366659/89 | 4/1990 |
| DE | 26 04 544 | 8/1977 |
| EP | 0 894 888 | 2/1999 |
| WO | 94/20661 | 9/1994 |

OTHER PUBLICATIONS

Derwent Abstract corresponding to DE 26 04 544 (AN 1977–57812Y [33]).
European Search Report.
Fox T.G., Bull. Am. Physics Soc., 1, 3, p. 123 (1956).
Polymer Handbook, 2nd Edition, J. Wiley & Sons, New York (1975).
Derwent Abstract corresponding to DE 26 04 544 [AN 1977–57812Y].
Derwent Abstract corresponding to EP 0 894 888 [AN 1999–108373].
Derwent Abstract corresponding to WO 94/20661 [AN 1994–280617].

*Primary Examiner*—Edward J. Cain
(74) *Attorney, Agent, or Firm*—Brooks & Kushman P.C.

(57) ABSTRACT

This invention relates to a process for prebinding fiber materials by means of a pulverulent binder composition. It further relates to the use of the prebound fiber material for producing plastics moldings from fiber-reinforced unsaturated polyester resins or epoxy resins by laying up the prebound fiber material, saturating the fiber material with the unsaturated polyester resin or epoxy resin and forming the molding.

12 Claims, No Drawings

PREBINDING OF FIBER MATERIALS

BACKGROUND OF THE INVENTION

1) Field of the Invention

This invention relates to a process for prebinding fiber materials by means of a pulverulent binder composition. It further relates to the use of the prebound fiber material for producing plastics moldings from fiber-reinforced unsaturated polyester resins or epoxy resins by laying up the prebound fiber material, saturating the fiber material with the unsaturated polyester resin or epoxy resin and forming the molding.

2) Background Art

High-strength sheetlike plastics parts such as, for example, automotive body parts, boat hulls and aircraft fuselages are known to be frequently produced from unsaturated polyester (UP) resins which are mechanically reinforced by means of glass, aramid or carbon fibers. The fibers are used in the form of wovens, nonwoven scrims or prebound fiber mats (=nonwovens). As part of the production process, the textile structures are draped in the molds and fully saturated with the liquid resin, and the prebinder present in the fiber mat is solubilized or dissolved by the styrene present in the UP resin. Consequently, the mats lose their intrinsic stiffness and become more readily conformable to the mold contours and at the same time the saturating of the fiber mats with the resin is speeded up.

The production process mentioned hitherto utilized thermoplastic polyester powders, especially polyester powders based on bisphenol A, as prebinders for the fiber mats. To this end, the bisphenol A polyester powders are sprinkled onto a previously laid glass web and melted during the subsequent oven trip, so that the glass fibers are bound by the molten polymer powder at their crossing points. The thusly prebound glass mats are then used for reinforcing UP resins. However, these prebinders have insufficient solubility kinetics in styrene monomers for certain applications.

A further important area of use for polymer powders is the prebinding of textile sheet materials for the purpose of shaping fiber mats before an injection resin is applied for example, for preforming prior to an RTM (=Resin Transfer Molding) process. What matters here in particular is to minimize fraying of the end-itemed fiber mat, to ensure the dimensional stability of a possibly preformed fiber mat and to avoid incompatibilities between preforming binder and injection resin.

AU-A 36659/89 describes a process for producing prebound fiber materials wherein glass fibers having two different lengths are bound with a triple combination binder comprising styrene-soluble polyester powder, polystyrene powder and polyvinyl acetate dispersion.

DE-A 2604544 describes styrene-soluble binders as unsuitable binders for consolidating fiber materials that are further processed using a thermoplastic melt. Instead, it recommends the use of hydroxyl- or carboxyl-containing polyacrylates prepared by solvent or bulk polymerization. Emulsion polymers are explicitly counseled against because the surface-active substances therein contaminate the binder and can lead to undesirable side-effects such as discoloration or thermal degradation.

EP-A 894888 discloses textile binders based on carboxyl-functional polymers which are used in combination with epoxide or isocyanate crosslinkers. Processes for producing prebound styrene-soluble fiber moldings are not discussed.

SUMMARY OF THE INVENTION

It is an object of the present invention to provide a pulverulent prebinder which dissolves very rapidly in a styrenic UP resin, but which is also useful for prebinding in processes where it is the compatibility of the prebinder with the polyester resin which is the chief concern.

The present invention accordingly provides a process for prebinding fiber materials which comprises mixing a pulverulent binder composition comprising a) a pulverulent copolymer obtainable by emulsion polymerization and subsequent drying of one or more monomers selected from the group consisting of vinyl esters, acrylic esters, methacrylic esters, vinylaromatics and vinyl chloride and 0.01 to 25% by weight, based on the total weight of the copolymer of one or more ethylenically unsaturated carboxyl-containing monomers, the copolymer having a glass transition temperature Tg or a melting point of above 35° C., and optionally, b) at least one pulverulent compound containing at least two reactive groups capable of reaction with the carboxyl groups mentioned under a), and having a melting point of 35° C., blending with the fibrous material and spreading out the mixture, or sprinkling the pulverulent binder on the spread-out fiber material and then binding the fiber material by raising the temperature to 50° C. to 250° C.

The present invention further provides for the use of the prebound fiber materials for producing plastics moldings from fiber-reinforced unsaturated polyester resins by laying up the prebound fiber material, saturating the fiber material with the unsaturated polyester resin and forming the molding.

The present invention further provides for the use of the prebound fiber material for producing preformed sheetlike structures "preforming" and for the use of these preformed fiber materials for producing fiber-reinforced plastics moldings from liquid resins such as, for example, epoxy resins.

DESCRIPTION OF THE PREFERRED EMBODIMENTS

Suitable copolymers are based on one or more monomers selected from the group comprising vinyl esters of unbranched or branched alkylcarboxylic acids having 1 to 15 carbon atoms, methacrylic esters and acrylic esters of alcohols having 1 to 10 carbon atoms, vinylaromatics such as styrene and vinyl chloride. Preferred vinyl esters are vinyl acetate, vinyl propionate, vinyl butyrate, vinyl 2-ethylhexanoate, vinyl laurate, 1-methylvinyl acetate, vinyl pivalate and vinyl esters of alpha-branched monocarboxylic acids having 5 to 11 carbon atoms, for example VeoVa5® or VeoVa9® (Shell Products). VeoVa5® and VeoVa9® are the vinyl esters of 5 and 9 carbon versatic acids. Preferred methacrylic esters or acrylic esters are methyl acrylate, methyl methacrylate, ethyl acrylate, ethyl methacrylate, propyl acrylate, propyl methacrylate, n-butyl acrylate, n-butyl methacrylate, 2-ethylhexyl acrylate.

It is essential that the composition of the copolymers is chosen so as to produce a glass transition temperature Tg or a melting point greater than 35° C., preferably of 55° C. to 150° C. The glass transition temperature Tg and the melting point of the polymers can be determined in a conventional manner by means of differential scanning calorimetry (DSC). The Tg can also be estimated in advance by means of the Fox equation. According to Fox T.G., Bull. Am. Physics Soc. 1, 3, page 123 (1956): $1/Tg=x_1/Tg_1+x_2/Tg_2+$.

. . $+x_n/Tg_n$, where $X_n$ is the mass fraction (% by weight/100) of monomer n and $Tg_n$ is the glass transition temperature in degrees Kelvin of the homopolymer of monomer n. Tg values for homopolymers are recited in Polymer Handbook $2^{nd}$ Edition, J. Wiley & Sons, New York (1975).

Preference is given to vinyl ester copolymers, styrene copolymers and acrylic ester copolymers. Particularly, preferred copolymers are vinyl acetate-ethylene, vinyl acetate-vinyl chloride, vinyl acetate-VeoVa5® and vinyl acetate-VeoVa9® copolymers which each contain 0.01 to 25% by weight of the carboxyl-containing monomer units mentioned and whose composition is chosen so as to produce the abovementioned glass transition temperatures Tg or melting points. Particular preference is also given to methyl methacrylate/butyl acrylate and styrene/butyl acrylate copolymers which each contain 0.01 to 25% by weight of the carboxyl-containing monomer units mentioned, and whose composition is chosen so as to produce the abovementioned glass transition temperatures Tg or melting points.

Suitable ethylenically unsaturated carboxyl-containing monomers are ethylenically unsaturated mono- or dicarboxylic acids such as acrylic acid, methacrylic acid, maleic acid, fumaric acid, itaconic acid. Carboxyl-containing comonomer units are preferably present in an amount of 0.01 to 10% by weight based on the total weight of the interpolymer.

If desired, the copolymers may further contain 0.01 to 10.0% by weight based on the total weight of the copolymers, of auxiliary monomers from the group of the ethylenically unsaturated carboxamides, preferably acrylamide, from the group of the ethylenically unsaturated sulfonic acids and salts thereof, preferably vinylsulfonic acid, from the group of the multiply ethylenically unsaturated comonomers, for example divinyl adipate, diallyl maleate, allyl methacrylate or triallyl cyanurate and/or from the group of the N-methylol(meth)acrylamides and also their ethers such as isobutoxy or n-butoxy ether. In a preferred embodiment, the interpolymers contain 0.01 to 2% by weight of each of acrylic acid and/or acrylamide.

The copolymers are prepared in a conventional manner by the emulsion polymerization process in the presence of emulsifier as described, for example, in WO-A 94/20661, whose disclosure in this regard is hereby incorporated herein by reference. The polymer dispersion obtainable thereby is dried to produce the powders. The drying can be effected by means of spray drying, drum drying, freeze drying or by coagulation of the dispersion and subsequent fluidized bed drying. Spray drying and drum drying are preferred. Preferably, the copolymer is prepared and dried without the addition of protective colloid.

Suitable crosslinkers are pulverulent compounds which have two or more reactive groups which form a covalent bond with carboxylic acid groups and have a melting point of 40° C. to 150° C. Suitable crosslinkers are epoxides, isocyanates, β-hydroxyalkylamides, organohalogen compounds, aziridines, carbodiimides, oxazolines, alcohols, amines, aminosilanes and aminoformaldehydes. Preference is given to compounds which contain two or more reactive groups selected from the group consisting of epoxides, isocyanates or β-hydroxyalkylamides. β-hydroxyalkylamides are available from Ems-Chemie A.G., Switzerland, as Primid β-hydroxyalkylamides.

Examples of suitable epoxide crosslinkers are those of the bisphenol A type, i.e., condensation products of bisphenol A and epichlorohydrin or methylepichlorohydrin. Suitable epoxide crosslinkers are commercially available, for example under the trade names of Epicote or Eurepox. Suitable diisocyanates are likewise common commercial products, for example m-tetramethylxylene diisocyanate (TMXDI), methylenediphenyl diisocyanate (MDI). The proportion of crosslinker generally ranges from 0.1 to 25% by weight, preferably from 4 to 12% by weight, based on the pulverulent copolymers.

It is customary to use combinations of the copolymer a) and the crosslinker b). This applies in particular for applications where high mechanical strength is demanded. In applications, in contrast, where the focus is on styrene solubility, it is also possible to do without a crosslinker.

In a preferred embodiment, the pulverulent binder composition further comprises a crosslinking catalyst based on organic compounds containing quaternary groups of elements of main group 5 of the periodic table. Preference is given to pulverulent catalysts derived from triphenylphosphonium halides or quaternary ammonium compounds. Examples thereof are methyl-, ethyl-, propyl-, butyltriphenylphosphonium bromide and the corresponding iodides and chlorides. It is also possible to use triphenylphosphonium halides having a substituted alkyl radical such as 2-carboxyethyl-, 3-bromopropyl- or formylmethyltriphenylphosphonium bromide. Suitable quaternary ammonium compounds are tetrabutylammonium, benzyltrimethylammonium, methyltributylammonium salts. The compounds mentioned are commercially available and are preferably used in amounts of 0.1 to 5% by weight, based on the pulverulent interpolymer.

Applications where the focus is on the melt flow characteristics are advantageously implemented using polymers a) having a molecular weight MW of 60,000 to 300,000. The molecular weight can be adjusted during the polymerization using chain transfer agents such as dodecyl mercaptan, in a manner known to one skilled in the art.

The pulverulent binder composition is produced by mixing the pulverulent components in the stated mixing ratios. Known apparatus for mixing powders can be used for this purpose.

Useful fiber materials includes any fibers customarily used for reinforcing fiber-reinforced plastics. This includes in particular glass fibers, polyamide fibers and carbon fibers. Among the polyamide fibers, preference is given to aramid fibers. The fiber materials can be used as individual filaments, as rovings or as nonwovens, wovens or nonwoven scrims. The fibers can be used not only each by themselves but also in the form of combinations with one another, for example, in the form of blend yarns or union cloths.

Fiber binding generally utilizes the powder composition in an amount of 1 to 50%, preferably 4 to 15%, particularly preferably 3 to 8%, of the fiber weight.

The moldings or sheet materials can be produced by mixing the fiber materials with the powder composition and laying down the mixture of fiber and powder by customary processes of nonwovens technology, for example by means of an airlay, wetlay, direct spinning or carding apparatus, prior to consolidation. The fiber/powder mixture may be carded, if desired. Subsequently, the temperature is raised, for example to 130° C. to 250° C., with or without the application of pressure and/or superheated steam, to bind the fiber material.

Alternatively, the fibers can be spread out sheetlike prior to consolidation, in which case, the fiber-powder mixture may additionally be carded, if desired, or a fiber/scrim, /woven or /nonwoven is laid out. The powder mixture is then sprinkled into the laid-out fiber material, preferably using powder sprinklers, drum application systems or electrostatic spraying. Subsequently, the temperature is raised, optionally by means of infrared or microwave, preferably to 130° C. to 250° C., with or without application of pressure and/or superheated steam, to bind the fiber material.

The prebound fiber materials thereby obtainable are useful as a semi-finished product for producing fiber-reinforced plastics that is notable for good and rapid solubility in styrene in particular. Plastics moldings are produced from fiber-reinforced unsaturated polyester resins by laying up the prebound fiber material, saturating the fiber material with the unsaturated polyester resin and finally forming the molding.

A further preferred area of use is the consolidation of glass, aramid or carbon fiber mats in the form of scrims or wovens, mixed scrims or mixed wovens by means of the powder composition, for which the above process description may be followed. The prebound fiber materials thereby obtainable are used, for example, for producing fiber-reinforced epoxy-bound RTM (RTM=Resin Transfer Molding) moldings or SMC (SMC=Sheet Molding Composites) moldings. To produce preformed sheet materials, the prebound fiber material can be formed in a suitable mold, if necessary with the application of elevated temperature and pressure.

The examples hereinbelow illustrate the invention.

INVENTIVE EXAMPLE 1

Production of a carboxyl-containing polymer powder A 3 liter capacity reactor was charged with 838.8 g of deionized water and 6.7 g of sodium lauryl sulfate and the contents were heated to 80° C. with stirring under nitrogen. At 80° C., the initiator solution (6.7 g of potassium peroxodisulfate and 218.4 g of water) was introduced into the reactor and the following compositions were metered into the reactor over 4 hours from separate containers:

| | |
|---|---|
| Monomer dose 1: | |
| Methacrylic acid | 67.3 g |
| Butyl acrylate | 403.7 g |
| Styrene | 861.3 g |
| Dodecyl mercaptan | 6.7 g |
| Monomer dose 2: | |
| Water | 67.3 g |
| Acrylamide (30%) | 44.9 g |
| Initiator dose: | |
| Water | 217.6 g |
| Potassium peroxodisulfate | 6.7 g |

On completion of metering, the polymerization was continued at 80° C. for about 2 hours. After cooling and adjustment of the pH to 8 by means of ammonia, the dispersion was spray dried. The glass transition temperature of this product was 59° C.

INVENTIVE EXAMPLE 2

Production of a Carboxyl-containing Polymer Powder

A 3 liter capacity reactor was charged with 855 g of deionized water and 6.7 g of sodium lauryl sulfate and the contents were heated to 80° C. with stirring under nitrogen. At 80° C., the initiator solution (6.7 g of potassium peroxodisulfate and 217.4 g of water) was introduced into the reactor and the following compositions were metered into the reactor over 4 hours from separate containers:

| | |
|---|---|
| Monomer dose 1: | |
| Methacrylic acid | 67.2 g |
| Butyl acrylate | 403.4 g |
| Styrene | 860.5 g |
| Dodecyl mercaptan | 6.7 g |
| Monomer dose 2: | |
| Water | 67.3 g |
| N-Methylolacrylamide (48%) | 28.0 g |
| Initiator dose: | |
| Water | 217.4 g |
| Potassium peroxodisulfate | 6.6 g |

On completion of metering, the polymerization was continued at 80° C. for about 2 hours. After cooling and adjustment of the pH to 8 by means of ammonia, the dispersion was spray dried. The glass transition temperature of this product was 59° C.

INVENTIVE EXAMPLE 3

Preparation of Powder Mix 98 g of the carboxyl-containing polymer powder of Example 1 was mixed in a powder mixer with 2 g of a pulverulent multifunctional epoxy compound.

INVENTIVE EXAMPLE 4

Preparation of Powder Mix 98 g of the carboxyl-containing polymer powder of Example 2 was mixed in a powder mixer with 2 g of a pulverulent multifunctional epoxy compound.

COMPARATIVE EXAMPLE 5

A commercial polyester powder based on an unsaturated ester.

COMPARATIVE EXAMPLE 6

A commercial polyester powder based on a bisphenol A fumarate.

COMPARATIVE EXAMPLE 7

A commercial polyester powder based on an unsaturated bisphenol polyester.

Production of a Glass Fiber Mat:

A glass fiber mat was produced by spreading glass rovings randomly over a support plate and in each case spreading them uniformly with a powder from the inventive or comparative examples. The powder was in each case applied in an amount of 5% by weight, based on the fiber weight. For consolidation, the support plate with the fiber/powder mix was heated at 210° C. for 3 minutes, in the course of which the powder melted, fully saturated the fibers and bound them together at the crossing points. The fiber mats obtained thereby were free of any discoloration.

Application Testing

Styrene Solubility

The fiber mats were cut to a specimen size of 10×15 cm, weighted with a 100 g weight and dipped vertically into styrene monomer. Styrene solubility was characterized by the time interval in seconds from the immersion to the breaking of the fiber mat.

The results of the application test are summarized in Table 1.

TABLE 1

| Prebinder | Styrene solubility [s] |
|---|---|
| Inventive Example 1 | 8 |
| Inventive Example 2 | 12 |
| Inventive Example 3 | 13 |
| Inventive Example 4 | 14 |
| Comparative Example 5 | 130 |
| Comparative Example 6 | 31 |
| Comparative Example 7 | 34 |

The table shows that the invention provides distinctly better styrene solubility than conventional prebinders.

Processing by RTM Process:

A carbon. fiber scrim was laid out and grounded and the powder of Inventive Example 1 was applied in an amount of 5% of the fiber weight by means of an electrostatic sprayer. A subsequent oven trip at 150° C./20 sec was used to preconsolidate the mat. The preconsolidated mat was then formed into a semispherical shape in a molding press.

This run was repeated with the powder of Inventive Example 3, except that a woven glass fiber fabric was used instead of a carbon fiber scrim.

The prebound and preformed scrims and wovens were dimensionally stable and readily transferable into an appropriately shaped injection mold without loss of shape.

What is claimed is:

1. A process for prebinding fiber materials which comprises mixing a pulverulent binder composition comprising a) a pulverulent copolymer obtained by emulsion polymerization and subsequent drying, of one or more monomers selected from the group consisting of vinyl esters, acrylic esters, methacrylic esters, vinylaromatics and vinyl chloride and 0.01 to 25% by weight, based on the total weight of the copolymer, of one or more ethylenically unsaturated carboxyl-containing monomers, the interpolymer having a glass transition temperature Tg or a melting point above 35° C., and optionally b) at least one pulverulent compound containing at least two reactive groups capable of reaction with the carboxyl groups mentioned under a), and having a melting point of 35° C. to 150° C., and mixing with the fibrous material and spreading out the mixture, or sprinkling the pulverulent binder on the spread-out fiber material and then binding the fiber material by raising the temperature to 50° C. to 250° C.

2. The process of claim 1, wherein the copolymer used is selected from the group consisting of vinyl acetate-ethylene, vinyl acetate-vinyl chloride, vinyl acetate-$C_5$ versatic acid vinyl ester, vinyl acetate-$C_9$ versatic acid vinyl ester, methyl methacrylate-butyl acrylate and styrene/butyl acrylate copolymers which each contain 0.01 to 25% by weight of carboxyl-containing monomer units.

3. The process of claim 1, wherein said one or more ethylenically unsaturated carboxyl-containing monomers are selected from the group consisting of acrylic acid, methacrylic acid, maleic acid, fumaric acid and itaconic acid.

4. The process of any of claims 1 to 3, wherein the one or more pulverulent compounds containing two or more reactive groups are selected from the group consisting of epoxides, isocyanates, β-hydroxyalkylamides, organohalogens, aziridines, carbodiimides, oxazolines, alcohols, amines, aminosilanes and aminoformaldehydes.

5. The process of claim 1, wherein the fiber material used is a glass fiber, polyamide fiber or carbon fiber.

6. Prebound fiber material obtainable by the process as claimed in any of claims 1 to 3.

7. A process for producing a plastic molding from fiber-reinforced saturated polyester resin which comprises laying up the prebound fiber material of claim 6, saturating the fiber material with the unsaturated polyester resin and forming the plastic molding.

8. The process of claim 7 wherein preformed fiber material is laid up with the prebound fiber material.

9. The process of claim 7 wherein the prebound fiber material is formed in a mold by the application of heat and pressure, prior to saturating with the unsaturated polyester resin.

10. The process of claim 7 for producing Resin Transfer Moldings (RTM).

11. The process of claim 7 for producing Sheet Molding Composites (SMC).

12. The plastic molding produced by the process of any of claims 7–11.

* * * * *